US008336584B2

(12) United States Patent
Belmonte

(10) Patent No.: US 8,336,584 B2
(45) Date of Patent: Dec. 25, 2012

(54) KITCHEN STORAGE BAG FILLING APPARATUS

(75) Inventor: David Belmonte, Atlanta, GA (US)

(73) Assignee: Edison Nation, LLC, Charlotte, NC (US)

( * ) Notice: Subject to any disclaimer, the term of this patent is extended or adjusted under 35 U.S.C. 154(b) by 333 days.

(21) Appl. No.: 12/838,611

(22) Filed: Jul. 19, 2010

(65) Prior Publication Data

US 2011/0013858 A1 Jan. 20, 2011

Related U.S. Application Data

(60) Provisional application No. 61/226,593, filed on Jul. 17, 2009.

(51) Int. Cl.
*B65B 1/04* (2006.01)

(52) U.S. Cl. ..... 141/314; 141/10; 141/337; 141/340

(58) Field of Classification Search ..... 141/10, 141/114, 312–316, 331, 333, 337, 340, 341, 141/365

See application file for complete search history.

(56) References Cited

U.S. PATENT DOCUMENTS

| | | | | |
|---|---|---|---|---|
| 3,936,087 | A * | 2/1976 | Alexander | 248/99 |
| 4,054,957 | A * | 10/1977 | Diamond | 4/144.2 |
| 4,469,300 | A | 9/1984 | Valesco | |
| 5,129,609 | A * | 7/1992 | Tobin | 248/97 |
| 5,772,046 | A | 6/1998 | Tercher | |
| 7,219,705 | B2 * | 5/2007 | Wallek | 141/340 |
| 7,246,641 | B2 * | 7/2007 | Blessman | 141/98 |
| 2007/0187558 | A1 | 8/2007 | Blodgett et al. | |

* cited by examiner

*Primary Examiner* — Gregory L. Huson
*Assistant Examiner* — Jason K Niesz
(74) *Attorney, Agent, or Firm* — Tillman Wright, PLLC; Chad D. Tillman; James D. Wright

(57) ABSTRACT

A kitchen storage bag filling device including a resilient sheet of water-resistant material having an interior portion and an exterior portion, separated by a pre-scored arc. A user grips and squeezes the interior portion of the sheet to bend the sheet along the pre-scored arc, thereby creating a free-standing funnel-like structure. The interior portion is inserted into a plastic bag and the plastic bag is held open to increase the ease of filling the bag with liquid or solid material.

19 Claims, 3 Drawing Sheets

KITCHEN STORAGE BAG FILLING APPARATUS

CROSS-REFERENCE TO RELATED APPLICATION

The present application is a U.S. nonprovisional patent application of, and claims priority under 35 U.S.C. §119(e) to, U.S. provisional patent application Ser. No. 61/226,593, filed Jul. 17, 2009, a copy thereof is attached hereto as Appendix A, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to a bag filling apparatus. More particularly, the invention pertains to a food storage bag holding device for supporting a supple plastic bag in an open position to facilitate filling of the bag.

Plastic bags are increasingly being used as food storage containers. Resealable plastic bags, such as ZIPLOC bags, are commonly used plastic bags which offer an effective and low cost manner of sealing food items within the bag for storage in a cupboard, refrigerator, or freezer. Resealable plastic bags are conveniently available in a multitude of sizes, such as quart and gallon, and provide for disposable manner of storage without having to resort to plastic or glass containers which require cleaning.

While plastic bags offer an effective alternative for food storage, the filling of plastic bags can be problematic due to the pliable and collapsible nature of the plastic bag. This problem is further enhanced when filling a plastic bag with food powders, sauces, or fluids.

A need exists for improvement in bag filling devices. This, and other needs, are addressed by one or more aspects of the present invention.

SUMMARY OF THE INVENTION

The present invention includes many aspects and features. Moreover, while many aspects and features relate to, and are described in, the context of a kitchen storage bag filling device, the present invention is not limited to use only in kitchen implementations, as will be to the Ordinary Artisan from the following summaries and detailed descriptions of aspects, features, and one or more embodiments of the present invention.

Accordingly, one aspect of the present invention relates to a bag filling apparatus. An exemplary such apparatus includes a resilient sheet of water-resistant material, including an interior portion and an exterior portion separated by a pre-scored arc. Furthermore, in this aspect of the invention, a user grips and squeezes the interior portion of the sheet to bed the sheet along the pre-scored arc, thereby creating a free-standing funnel-like structure. The interior portion is then configured for insertion into a plastic bag to permit the plastic bag to be held open.

In a feature of this aspect of the invention, a notch is located on either side of the sheet to aid in holding open the plastic bag. In another feature, the sheet contains a hold to allow the apparatus to be hung on a hook. In yet another feature, the sheet is sized to fill a quart-sized bag. In an alternative feature, the sheet is sized to fill a gallon-sized bag. In yet another feature, the plastic bag has a zip-seal and the zip-seal is held in place by the notches. In another feature of this aspect, the resilient sheet is constructed of a water-resistant plastic.

Another aspect of the invention relates to a method of filling a bag. An exemplary such method includes providing an apparatus including a resilient sheet of water-resistant material having an interior portion and an exterior portion separated by a pre-scored arc. Furthermore, in this aspect of the invention, a user grips the sheet by the interior portion, squeezes the sheet, thereby causing it to bend along the arc, thereby creating a supporting side on the exterior portion and a funnel side on the interior portion, inserting the interior portion into a bag, releasing the grip, filling the bag, and removing the interior portion from the bag.

In another aspect, a device facilitating the filling of a pliable bag includes a resilient, generally planar sheet of material, including a first portion and a second portion separated by a hinge. The resilient sheet is configured such that flexing of the first portion into a generally curved surface results in the second portion moving toward the first portion by bending of the sheet along the hinge. Tension in the sheet urges the first portion toward a generally planar configuration. Additionally, the flexed first portion is dimensioned to be inserted through the mouth of a pliable bag and into the interior storage area of the bag, and to engage the side walls of the bag while in a flexed position such that the side walls of the bag engage and maintain the first portion in such flexed position. The second portion is dimensioned to extend from the bag and support the mouth of the bag at an elevated position above a surface on which the bag and device are supported.

In a feature, the hinge comprises a curved line of reduced thickness relative to the first portion and to the second portion.

In a feature, the sheet of material is water-resistant.

In a feature, the device further includes a notch on each side of the sheet, wherein the notch aids in holding open the bag.

In a feature, the sheet further comprises an opening that enables the device to be hung on a hook.

In a feature, the sheet is dimensioned to be used with a quart-sized bag.

In a feature, the sheet is dimensioned to be used with a gallon-sized bag.

In a feature, the resilient sheet is constructed of water-resistant plastic.

In another aspect, an apparatus includes a pliable bag and a sheet of material. The sheet of material includes a first portion and a second portion separated by a hinge. The sheet of material is configurable between: a first configuration, in which the resilient sheet of material is generally planar; and a second configuration, in which the first portion is altered into a generally curved surface and the second portion is altered to extend at an angle to the first portion. Furthermore, the first portion is received within the bag in the altered state and the second portion extends from the bag to support a mouth of the bag at an elevated position above a surface on which the apparatus is supported.

In a feature, the sheet is resilient.

In a feature, the sheet is malleable.

In a feature, the bag has a zip-seal, wherein the first portion of the sheet includes side notches, and wherein the zip-seal is retained by the side notches such that the bag is held in place along a predetermined extent of the first portion.

In yet another aspect, a method of filling a bag includes the steps of: providing a device comprising a resilient sheet of water-resistant material, including an interior portion and an exterior portion separated by a pre-scored arc; gripping the device by the interior portion; squeezing the device and causing it to bend along the arc, thereby creating a supporting side on the exterior portion and a funnel side on the interior portion; inserting the interior portion into a bag; releasing the grip; filling the bag; and removing the device from the bag.

In other aspects, methods of filling a bag include use of the foregoing devices and apparatus.

In addition to the aforementioned aspects and features of the present invention, it should be noted that the present invention further encompasses the various possible combinations and subcombinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
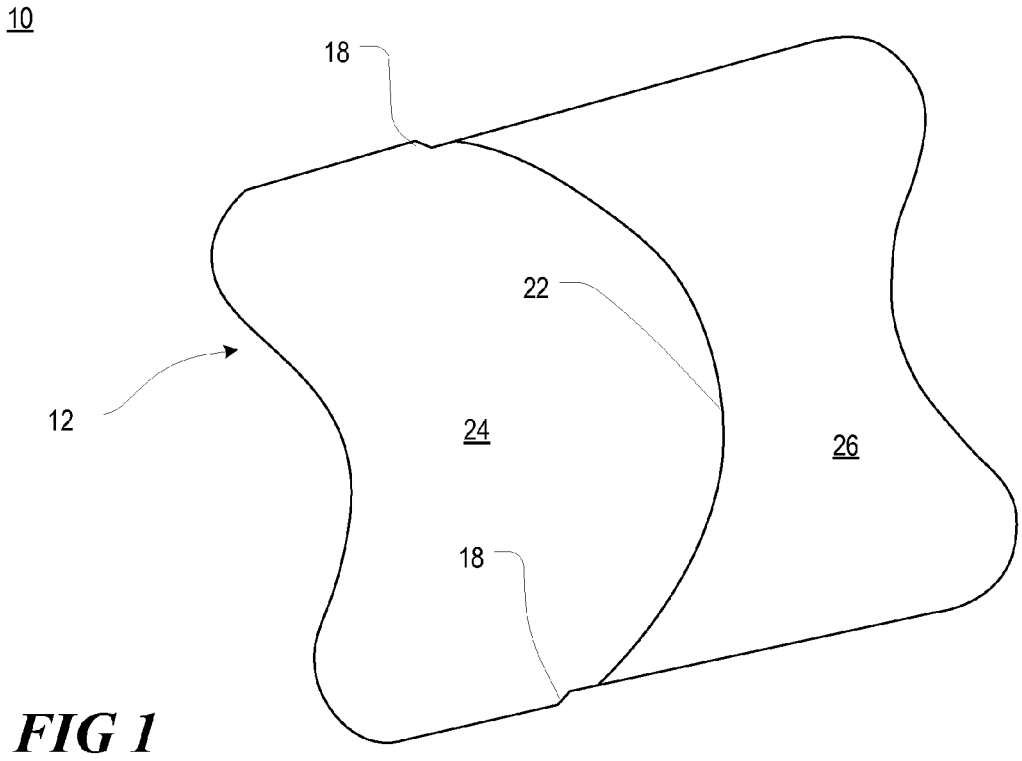
FIG. 1 is a top view of a kitchen storage bag filling device in accordance with a preferred embodiment of the invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

FIG. 1 is an illustration showing a top view of a kitchen storage bag filling device 10 in accordance with a preferred embodiment of the invention. As shown in FIG. 1, the device 10 comprises a semi-clear, resilient plastic sheet 12. The plastic sheet 12 preferably is integrally formed during manufacture in a molding process.

The sheet 12 is shown in an unfolded—or open—configuration representing its "at rest"—or "relaxed"—configuration. In the relaxed configuration, the sheet 12 extends in generally planar fashion and may be easily stored in a drawer or cabinet. Additionally, or alternatively, the sheet 12 may define an opening—or hole—by which the device 10 is hung, for example, in a pantry or cabinet.

The device 10 also preferably is dishwasher-safe, and when in the relaxed configuration, the device 10 is easily placed in a dishwasher. As will be apparent from the following description, the device 10 is designed to cleanly and efficiently fill kitchen storage bags of various sizes.

In alternative designs, the device may be constructed of any liquid-resistant material, whether transparent, translucent or opaque.

The sheet 12 of the device 10 includes notches 18 on either side of lateral edges of the plastic sheet 12, which preferably serve to hold a kitchen storage bag 16 in place at a zipper line 20 when the device 10 is used, as described below.

The sheet 12 of the device 10 further defines a hinge in the form of a curved, scored line or arc 22 that divides the sheet 12 of the device 10 into two portions, namely: a first, "interior" portion 24 on a first side of the arc 22 containing the arc radius; and a second, "exterior" portion 26 on a second side of the arc 22 opposite the arc radius. In this case, the first and second portions 24,26 preferably include substantially the same thickness, and are joined by an area of reduced thickness which defines the "scored line."

The interior portion 24 acts as a guide (or funnel) when the interior portion 24 is inserted into a bag 16 during use of the device 10, as described below. The exterior portion 26 in turn acts as a support and defines two feet for supporting the device 10 and bag 16 during use, as described below.

In alternative designs of the device 10, the first and second portions 24,26 have different thicknesses and are joined along a boundary that generally corresponds to the illustrated scored line or arc 22 of FIGS. 1-4. In such scenarios, the thickness of the first portion 24 may be greater or less than that of the second portion 26. Moreover, the resilient characteristics of the first portion 24 may be greater or lesser than those of the second portion 26, as desired. The first and second portions 24,26 also may be separately formed and joined together in a flexible manner such that substantially the same operational characteristics as those of the device 10 are achieved, as described below.

Figure 2:
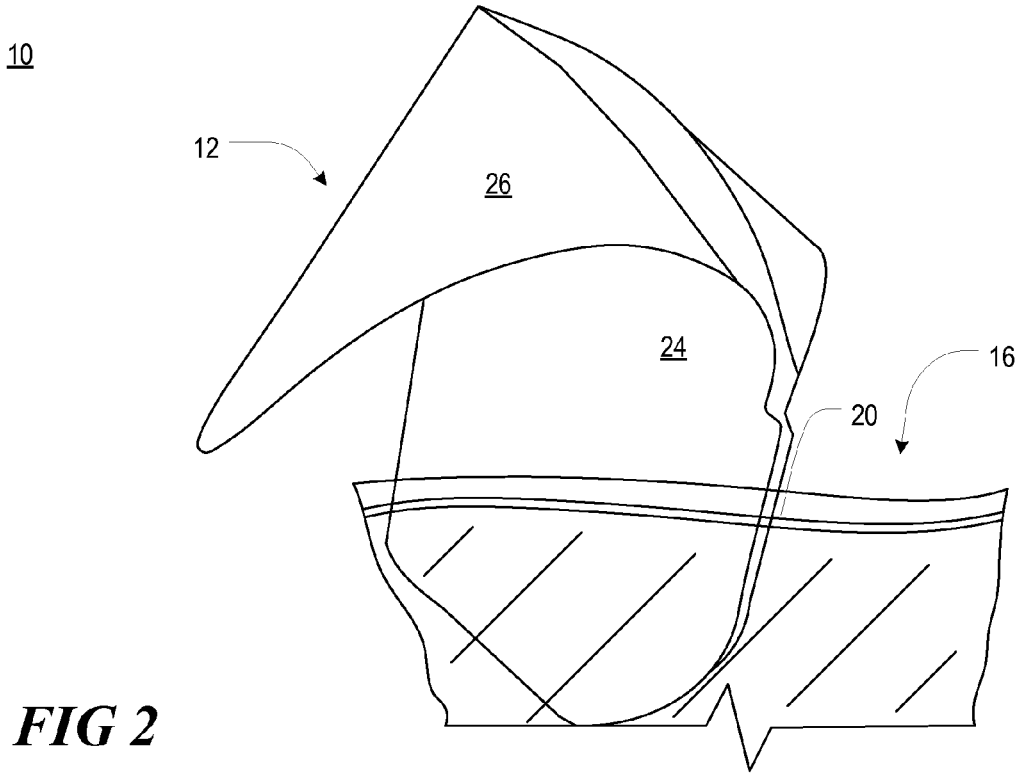
FIG. 2 is an illustration of the kitchen storage bag filling device of FIG. 1, showing the device in a folded position and being inserted into a kitchen storage bag.
Figure 3:
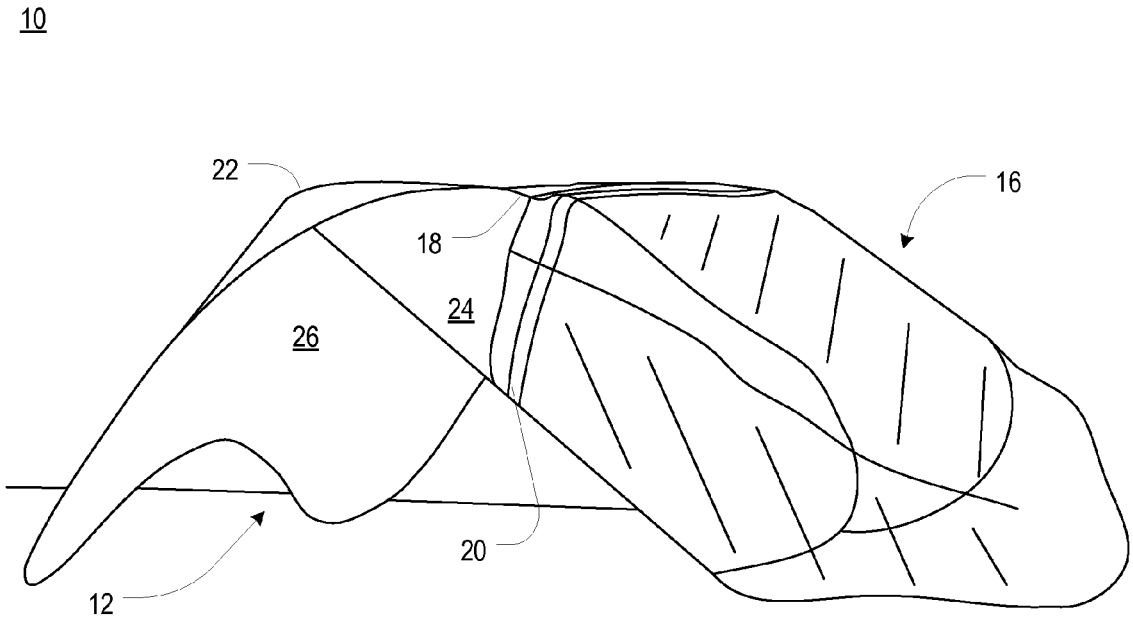
FIG. 3 is an illustration of the kitchen storage bag filling device of FIG. 1, showing the device supporting a kitchen storage bag in an open position.
Figure 4:
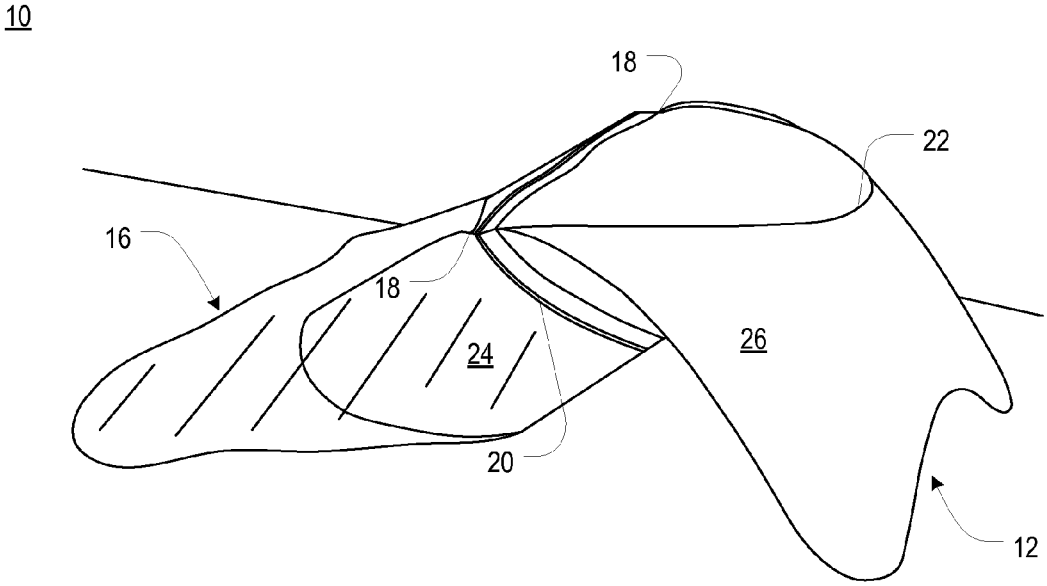
FIG. 4 is an illustration of the kitchen storage bag filling device of FIG. 1, further depicting the device supporting a kitchen storage bag in an open position.

In particular, due to both the resilient characteristics of the sheet 12 and the geometry of the scored line defining the boundary between the interior and exterior portions 24,26, the exterior portion 26 tends to bend downwardly at an angle to the interior portion 24 when the interior portion 24 is flexed, pinched or squeezed by hand into a generally curved, cylindrical shape as shown in FIG. 2. In this configuration, the interior portion 24 of the sheet 12 is insertable through a mouth of the bag 16. Moreover, the sheet preferably is dimensioned such that the bag 16 is stretched taut and retains the interior portion 24 of the sheet 12 in the generally curved, cylindrical shape after being released by the hand, as shown in FIG. 3 and FIG. 4.

Indeed, the tensile forces of the bag 16 are sufficient to prevent the device 10 from springing back toward the relaxed configuration. Conversely, the forces of the tensioned sheet 12 serve to hold the mouth of the bag 16 open for receiving contents therein.

It will be immediately appreciated that, once released with the interior portion 24 extending within the bag 16 and the exterior portion 26 extending outside of the bag 16, the sheet 12 in combination with the bag 16 becomes a freestanding and stable funnel-like structure that facilitates loading of contents into the bag 16.

It will further be appreciated that the freestanding design virtually eliminates kitchen storage bag filling hassles, even allowing the user to stop anytime during the process. The user can now load food or liquid into the kitchen storage bag 16 without the mess or without compromising the bag's 16 seal. The device 10 indicates "fill capacity" of the storage bag 16 when food or liquid reaches the bottom or the backside of the interior portion 24. More volume may be added by tilting and slightly lifting the device 10 and bag 16. When finished, the bag filling device 10 is easily removed by gripping and squeezing the interior portion 24 and then withdrawing the device 10 from the bag 16. The device 10 may then be cleaned by hand or placed in a dishwasher for subsequent cleaning.

Figure 5:
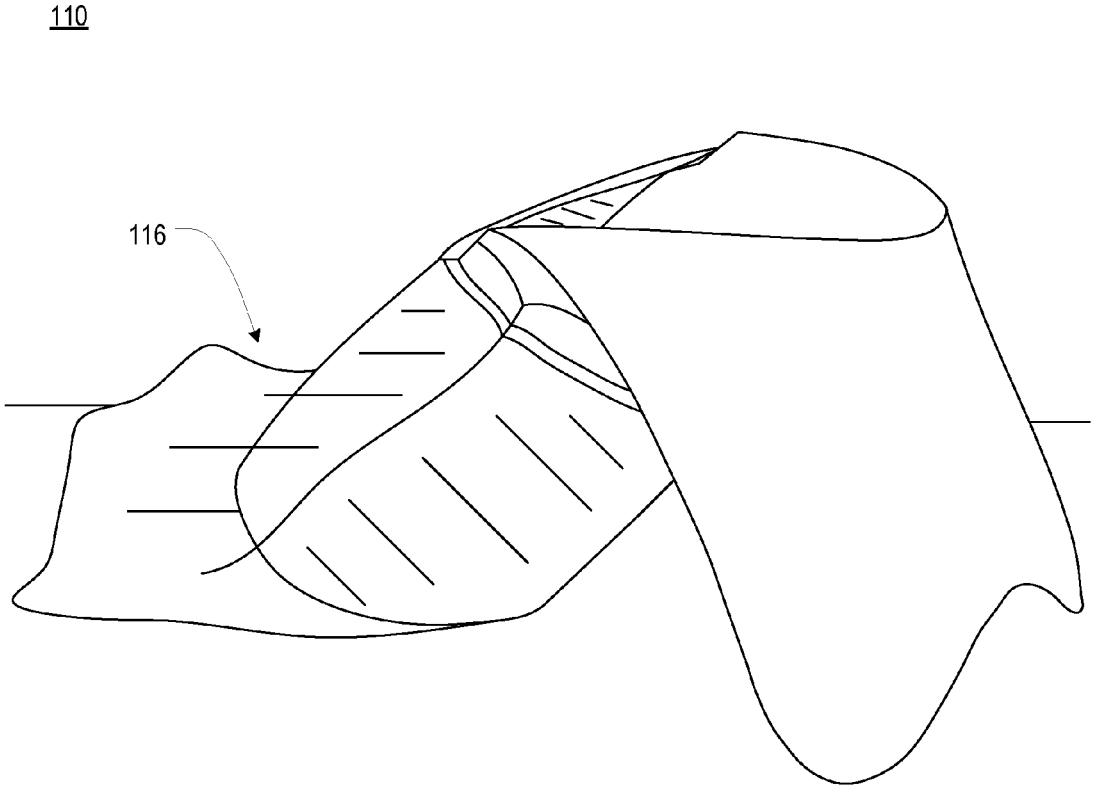
FIG. 5 is an illustration of a kitchen storage bag filling device in accordance with another preferred embodiment of the invention.

The device 10 shown in FIGS. 1-4 is sized to fit a quart-sized kitchen storage bag 16. In alternative embodiments, the device may be sized to fill kitchen storage bags of various sizes, including gallon-sized bags. FIG. 5 shows a kitchen storage bag filling device 110 that fits a gallon-sized kitchen storage bag 116.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

For example, such alternative embodiments within the scope of the invention include a device similar to those disclosed above, but wherein the sheet is semirigid and malleable and not resilient. In such alternative, the sheet nevertheless may be bent and manipulated by hand into the same shape as the device 10 of FIGS. 3 and 4, wherein the bent and manipulated malleable sheet is sufficiently rigid so as to maintain the bag in the same illustrated condition.

What is claimed is:

1. A device facilitating the filling of a pliable bag, the device comprising:

a resilient, generally planar sheet of material, including a first portion and a second portion separated by a hinge, the resilient sheet configured such that flexing of the first portion into a generally curved surface results in the second portion moving toward the first portion by bending of the sheet along the hinge;

wherein tension in the sheet urges the first portion toward a generally planar configuration;

wherein the flexed first portion is dimensioned to be inserted through the mouth of a pliable bag and into the interior storage area of the bag, and to engage the side walls of the bag while in a flexed position such that the side walls of the bag engage and maintain the first portion in such flexed position; and wherein the second portion is dimensioned to extend from the bag and support the mouth of the bag at an elevated position above a surface on which the bag and device are supported.

2. The device of claim 1, wherein the hinge comprises a curved line of reduced thickness relative to the first portion and to the second portion.

3. The device of claim 1, wherein the sheet of material is water-resistant.

4. The device of claim 1, further comprising a notch on each side of the sheet, wherein the notch aids in holding open the bag.

5. The device of claim 1, wherein the sheet further comprises an opening that enables the device to be hung on a hook.

6. The device of claim 1, wherein the sheet is dimensioned to be used with a quart-sized bag.

7. The device of claim 1, wherein the sheet is dimensioned to be used with a gallon-sized bag.

8. The device of claim 1, wherein the resilient sheet is constructed of water-resistant plastic.

9. The device of claim 1, wherein the sheet of material is translucent.

10. An apparatus, comprising:

a pliable bag; and a sheet of material comprising a first portion and a second portion separated by a hinge, the sheet of material being configurable between, a first configuration, in which the resilient sheet of material is generally planar, and a second configuration, in which the first portion is altered into a generally curved surface and the second portion is altered to extend at an angle to the first portion;

wherein the first portion is received within the bag in the altered state and wherein the second portion extends from the bag and to support a mouth of the bag at an elevated position above a surface on which the apparatus is supported.

11. The apparatus of claim 10, wherein the sheet is resilient.

12. The apparatus of claim 10, wherein the sheet is malleable.

13. The apparatus of claim 10, wherein the sheet is translucent.

14. The apparatus of claim 10, wherein the sheet is water-resistant.

15. The apparatus of claim 10, wherein the sheet further comprises an opening that enables the device to be hung on a hook.

16. The apparatus of claim 10, wherein the bag has a zip-seal, wherein the first portion of the sheet includes side notches, and wherein the zip-seal is retained by the side notches such that the bag is held in place along a predetermined extent of the first portion.

17. The apparatus of claim 10, wherein the bag is a quart-sized bag.

18. The apparatus of claim 10, wherein the bag is a gallon-sized bag.

19. A method of filling a bag, comprising:

providing a device comprising a resilient sheet of water-resistant material, including an interior portion and an exterior portion separated by a pre-scored arc;

gripping the device by the interior portion;

squeezing the device and causing it to bend along the arc, thereby creating a supporting side on the exterior portion and a funnel side on the interior portion;

inserting the interior portion into a bag;

releasing the grip;

filling the bag; and removing the device from the bag;

wherein a user grips and squeezes the interior portion of the sheet to bend the sheet along the pre-scored arc, thereby creating a free-standing funnel-like structure, wherein the interior portion is configured for insertion into a plastic bag to permit the plastic bag to be held open.

* * * * *